US012043997B2

(12) United States Patent
Chen et al.

(10) Patent No.: US 12,043,997 B2
(45) Date of Patent: Jul. 23, 2024

(54) KITCHEN SINK CAPABLE OF QUICKLY REPLACING DECORATIVE PLATES

(71) Applicant: FORTUNE INDUSTRIAL (VIETNAM) JOINT STOCK COMPANY, Trang Bang Town (VN)

(72) Inventors: Cali Chen, Trang Bang Town (VN); Mincong Ye, Trang Bang Town (VN)

(73) Assignee: FORTUNE INDUSTRIAL (VIETNAM) JOINT STOCK COMPANY, Trang Bang Town (VN)

( * ) Notice: Subject to any disclaimer, the term of this patent is extended or adjusted under 35 U.S.C. 154(b) by 52 days.

(21) Appl. No.: 17/876,684

(22) Filed: Jul. 29, 2022

(65) Prior Publication Data

US 2024/0035263 A1 Feb. 1, 2024

(51) Int. Cl.
*E03C 1/18* (2006.01)
*E03C 1/32* (2006.01)

(52) U.S. Cl.
CPC . *E03C 1/18* (2013.01); *E03C 1/32* (2013.01)

(58) Field of Classification Search
CPC .. A47B 2096/207; A47B 96/20; A47B 96/205
See application file for complete search history.

(56) References Cited

U.S. PATENT DOCUMENTS

| | | | | |
|---|---|---|---|---|
| 6,154,895 | A * | 12/2000 | Pisklak | E03C 1/18 4/584 |
| 6,212,707 | B1 * | 4/2001 | Thompson | A47K 1/00 4/619 |
| D624,635 | S * | 9/2010 | Eckhaus | D23/308 |
| 10,501,919 | B2 * | 12/2019 | Chong | E03C 1/335 |
| 11,149,421 | B2 * | 10/2021 | Liang | E03C 1/18 |
| 11,286,652 | B2 * | 3/2022 | Miller | A47B 96/20 |
| 11,324,318 | B2 * | 5/2022 | Miller | A47B 96/201 |
| 2005/0223486 | A1 * | 10/2005 | Jumalon | A47B 77/06 4/619 |
| 2010/0229437 | A1 * | 9/2010 | Forrest | A47B 47/05 16/110.1 |

* cited by examiner

*Primary Examiner* — Erin Deery
(74) *Attorney, Agent, or Firm* — Birchwood IP

(57) ABSTRACT

The present disclosure relates to the field of kitchen sink, a kitchen sink capable of replacing decorative plates. The kitchen sink capable of replacing decorative plates comprises a kitchen sink body, decorative plates and mounting plates, wherein the upper edge, the edge of the front side wall of the kitchen sink body are provided with mounting grooves with an open inner side, the decorative plates are capable of being inserted into the mounting grooves from bottom to top, the mounting plates comprise a bottom plate bent backwards and a front plate bent upwards, the bottom plate is magnetically connected or clamped with the kitchen sink body, and the front plate is attached to the front side of the decorative plates. By disassembling and assembling the mounting plates, the decorative plates can be quickly replaced, which is convenient to use different decorative plates according to the demands of users.

6 Claims, 12 Drawing Sheets

KITCHEN SINK CAPABLE OF QUICKLY REPLACING DECORATIVE PLATES

TECHNICAL FIELD

The present disclosure relates to the field of kitchen sink, in particular to a kitchen sink capable of quickly replacing decorative plates.

BACKGROUND

Cabinets are always provided in modern kitchens. When the board at the top of the cabinet is perforated, the kitchen sink can be embedded in the cabinet. When the depth of the kitchen sink is large or the board at the top of the cabinet is narrow, the hole can be set into a U-shape with a forward opening when the board at the top of the cabinet is perforated, so that the front of the kitchen sink is exposed. At this time, it is necessary to provide a decorative plate at the front of the kitchen sink to block the kitchen sink. Then, a cabinet door is provided below the kitchen sink, so that the cabinet door is flush with the decorative plate of the kitchen sink. The kitchen sink and the cabinet are simple and beautiful in appearance when viewed from the front side.

In the prior art, there are standard sizes and specifications of kitchen sinks in the industry of kitchen sink to facilitate batch production of kitchen sink. There are generally two methods to mount decorative plates on kitchen sink. One method is to mount a whole block of rough marble on the front side of a complete kitchen sink as decoration, which is costly. The other method is to make a kitchen sink without a front plate, and fix the decorative plate on the front side of the kitchen sink as the front plate of the kitchen sink. With this method, it is complicated to replace the decorative plate, and there are few colors and patterns to choose from.

Because a cabinet of a user is customized according to the decoration style, the colors and patterns of cabinet doors are ever-changing. However, the above two methods of mounting decorative plates on the kitchen sink in the prior art cannot meet the requirements of the user for matching various kitchen styles, and the decorative plates of the kitchen sink cannot keep the same or close to the colors and patterns of cabinet doors.

SUMMARY

In order to solve the above technical problems, the present disclosure aims to provide a kitchen sink capable of quickly replacing decorative plates, which can quickly replace decorative plates, and is convenient to use decorative plates with different styles and hues according to the demands of users.

In order to solve the problem, the technical scheme used by the present disclosure is as follows: a kitchen sink capable of quickly replacing decorative plates, comprising:

a kitchen sink body, decorative plates and mounting plates, wherein the upper edge, the left edge and the right edge of the front side wall of the kitchen sink body are all provided with mounting grooves with an open inner side, the decorative plates are capable of being inserted into the mounting grooves from bottom to top, the mounting plates comprise a bottom plate bent backwards and a front plate bent upwards, the bottom plate is magnetically connected or clamped with the kitchen sink body, and the front plate is attached to the front side of the decorative plates.

The decorative plate is inserted into the mounting groove. Since the mounting plate is magnetically connected or clamped with the kitchen sink body, the mounting plate can be quickly mounted on or detached from the kitchen sink body, and the mounting plate is configured to support the lower edge of the decorative plate to prevent the decorative plate from falling down. By disassembling and assembling the mounting plates, the decorative plates can be quickly replaced, which is convenient to use different decorative plates according to the demands of users.

As a further improvement of the above technical scheme, the kitchen sink further comprises a magnetic attraction plate which is provided on the bottom plate and is magnetically connected or welded with the bottom plate. One of the preferable technical schemes of the present disclosure is to provide a magnetic absorption plate to realize the function of magnetic connection between the bottom plate and the kitchen sink body.

As a preferable technical scheme, the bottom of the front tank body is provided with a hinge, and the bottom plate is hinged with the bottom of the front tank body through the hinge.

As a preferable technical scheme, the kitchen sink body comprises a main tank body with an open top and a front tank body with an open rear, the top of the main tank body is provided with a flange, the top of the front tank body is welded with the flange, and the bottom of the inner cavity of the front tank body is provided with a magnet. The magnet is provided, which is conducive to strengthening the attraction between the mounting plate and the front tank body, and the front tank body is mainly configured to mount decorative plates.

As a preferable technical scheme, the kitchen sink further comprises a connector, the bottom of the front tank body is provided with a connecting wall which turns upwards, and the connecting wall is connected with the front side wall of the main tank body through the connector. The connector is configured to fix the relative position of the lower part of the front tank body and the lower part of the main tank body.

As a preferable technical scheme, the connector is a U-shaped sheet metal part, the connector is welded with the lower part of the front side wall of the main tank body, the connector is welded with the connecting wall, and the connector is completely hidden in the rear side of the front tank body. The technical scheme is reliable and beautiful.

As a preferable technical scheme, the bottom of the front tank body is provided with a hook, a gap is formed between the hook and the bottom of the front tank body, and the bottom plate is inserted into the gap.

As a preferable technical scheme, the connector comprises two parts which are bilaterally symmetrically provided.

The present disclosure has the following beneficial effects. The decorative plate is inserted into the mounting groove. Since the mounting plate is magnetically connected or clamped with the kitchen sink body, the mounting plate can be quickly mounted on or detached from the kitchen sink body, and the mounting plate is configured to support the lower edge of the decorative plate to prevent the decorative plate from falling down. By disassembling and assembling the mounting plates, the decorative plates can be quickly replaced, which is convenient to use different decorative plates according to the demands of users.

BRIEF DESCRIPTION OF DRAWINGS

The present disclosure will be further explained with reference to the drawings and specific embodiments hereinafter.

Figure 1:
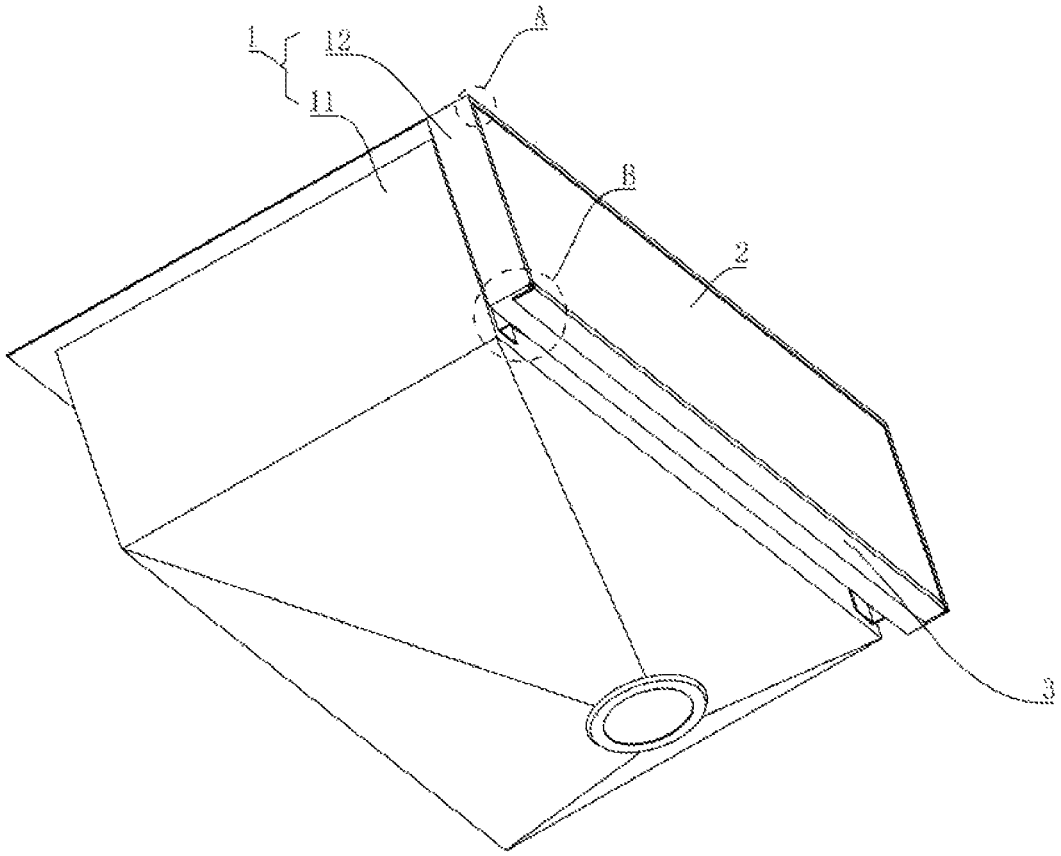
FIG. 1 is a structural diagram of a first embodiment of a kitchen sink capable of quickly replacing decorative plates according to the present disclosure.

In the figures: 1—kitchen sink body, 11—main tank body, 111—flange, 12—front tank body, 121—stop strip, 13—mounting groove, 2—decorative plate, 3—mounting plate, 31—bottom plate, 32—front plate, 4—magnetic absorption plate, 5—magnet, 6—connector, 7—hook, 8—hinge.

DETAILED DESCRIPTION

In this section, the specific embodiments of the present disclosure will be described in detail the preferred embodiments of the present disclosure are shown in the attached drawings. The attached drawings serve to supplement the description in the written part of the specification with figures, so that people can intuitively and vividly understand each technical feature and the overall technical scheme of the present disclosure, but it should not be understood as limiting the scope of protection of the present disclosure.

In the description of the present disclosure, it should be understood that the directional or positional relationships related to the directions, such as up, down, front, back, left, right, etc., are based on the directional or positional relationships shown in the drawings, so as to only facilitate the description of the present disclosure and simplify the description, rather than indicate or imply that the referred devices or elements must have a specific direction, be constructed and operated in a specific direction, so that it cannot be understood as a limitation of the present disclosure.

In the description of the present disclosure, "several" means one or more, and "a plurality of" means more than two. The terms such as "greater than", "less than", "more than", etc. are understood as excluding this number. The terms such as "above", "below", "within", etc. are understood as including this number. The descriptions such as "first" acid "second" are only used for the purpose of distinguishing technical features, rather than be understood as indicating or implying relative importance, implicitly indicating the number of indicated technical features or implicitly indicating the sequence of indicated technical features.

In the description of the present disclosure, unless otherwise specified, words such as "provide", "mount", "connect", etc. should be understood in a broad sense. Those skilled in the art can reasonably determine the specific meanings of the above words in the present disclosure in conjunction with the specific contents of the technical scheme.

As shown in FIG. 1 to FIG. 11, a first embodiment of a kitchen sink capable of quickly replacing a decorative plate 2 according to the present disclosure comprises:

as shown in FIG. 1, a kitchen sink body 1, wherein the kitchen sink body 1 comprises a main tank body 11 with an open top and a front tank body 12 with an open rear.

Figure 2:
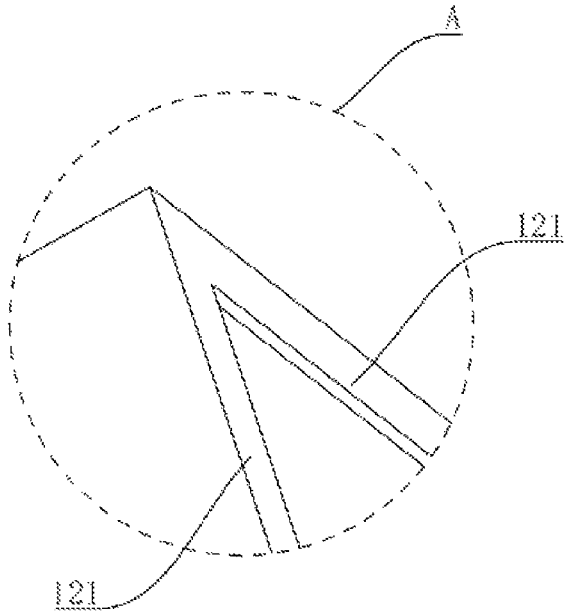
FIG. 2 is an enlarged view of part A of FIG. 1.
Figure 3:
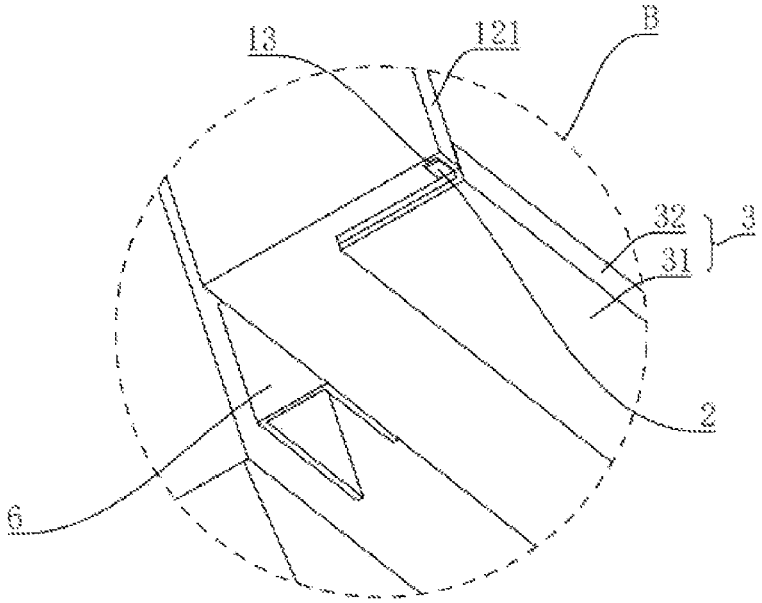
FIG. 3 is an enlarged view of part B of FIG. 1.

As shown in FIG. 2 and FIG. 3, the upper edge, the left edge and the right edge of the front side wall of the front tank body 12 are all provided with mounting grooves 13 with an open inner side. The edge of the front side wall of the front tank body 12 is provided with three stop strips 121 connected in sequence, and a gap is provided between the stop strips 121 and the front tank body 12 to form the mounting grooves 13.

Figure 4:
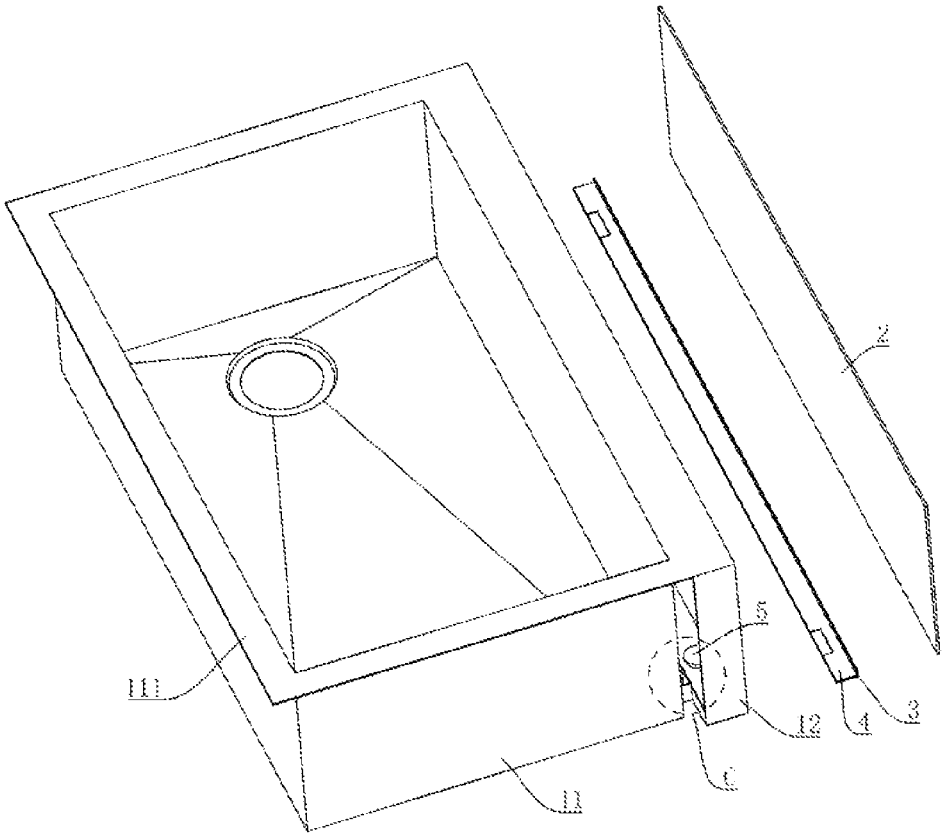
FIG. 4 is an exploded view of a first embodiment of a kitchen sink capable of quickly replacing decorative plates according to the present disclosure.
Figure 6:
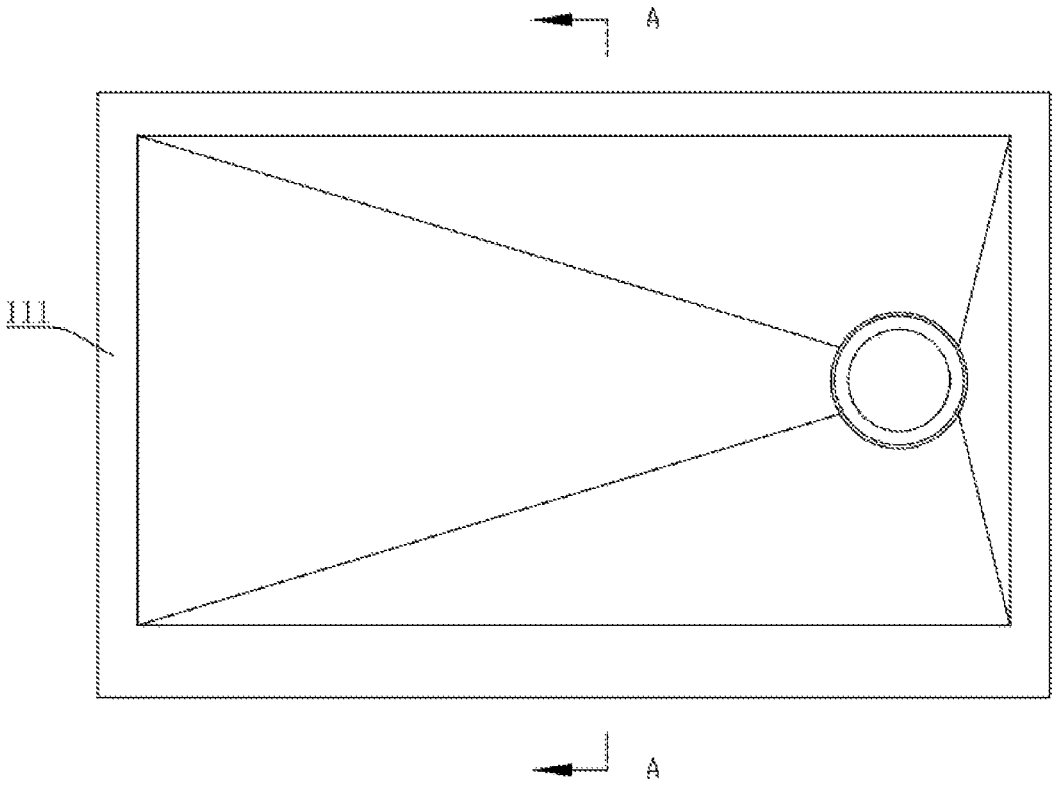
FIG. 6 is a top view of a first embodiment of a kitchen sink capable of quickly replacing decorative plates according to the present disclosure.
Figure 7:
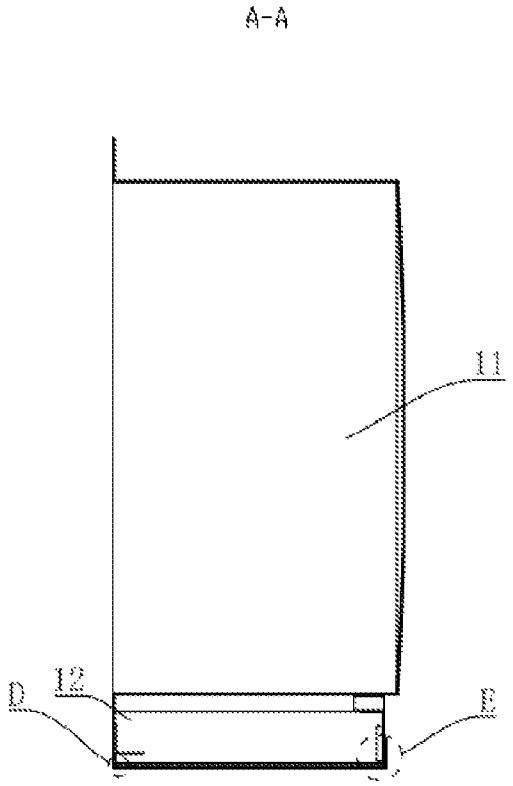
FIG. 7 is a cross-sectional view taken along line A-A of FIG. 6.
Figure 8:
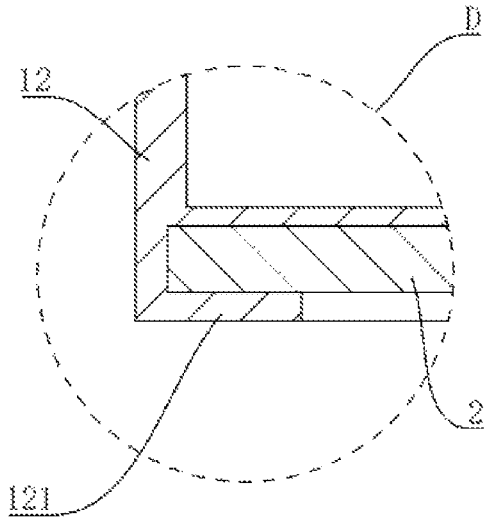
FIG. 8 is an enlarged view of part D of FIG. 7.

As shown in FIGS. 4 and 6, the top of the main tank body 11 is provided with a flange 111. The top of the front tank body 12 is welded with the flange 111. The front edge of the flange 111 is flush with the stop strip 121. The rear and the side of the flange 111 are used for hanging on the kitchen top. The bottom of the front tank body 12 is provided with a connecting wall 122 which turns upwards, and the bottom of the inner cavity of the front tank body 12 is provided with a magnet 5.

Figure 5:
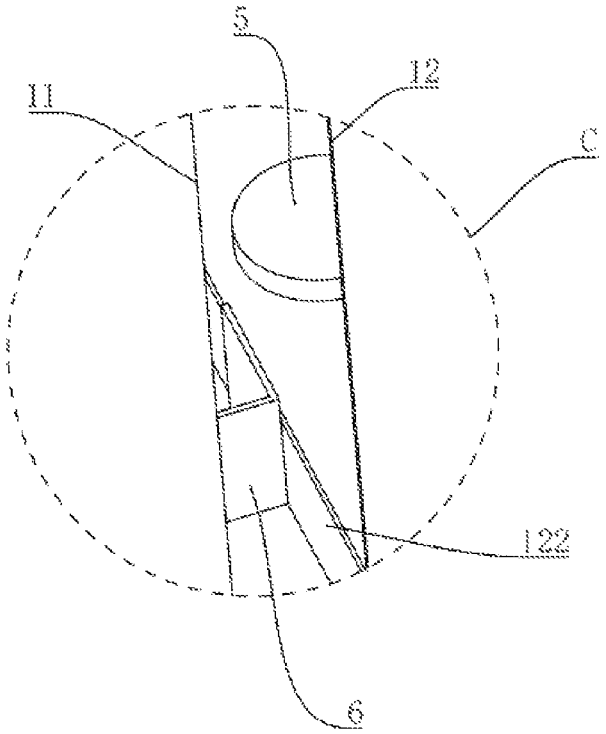
FIG. 5 is an enlarged view of part C of FIG. 4.
Figure 10:
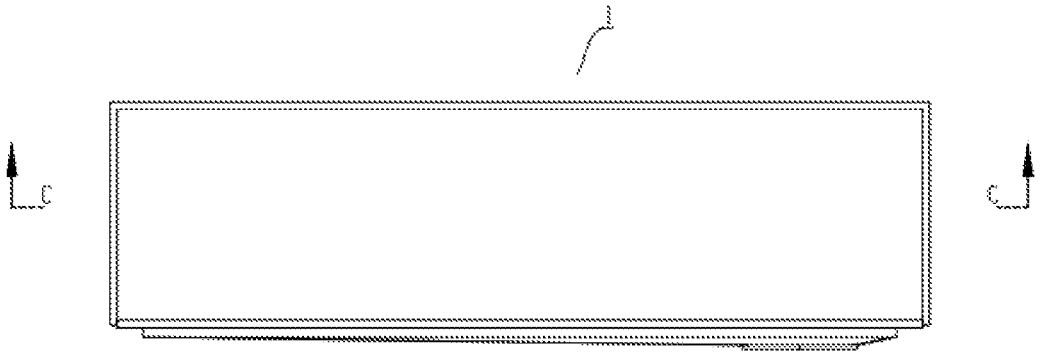
FIG. 10 is a front view of a first embodiment of a kitchen sink capable of quickly replacing decorative plates according to the present disclosure.
Figure 11:
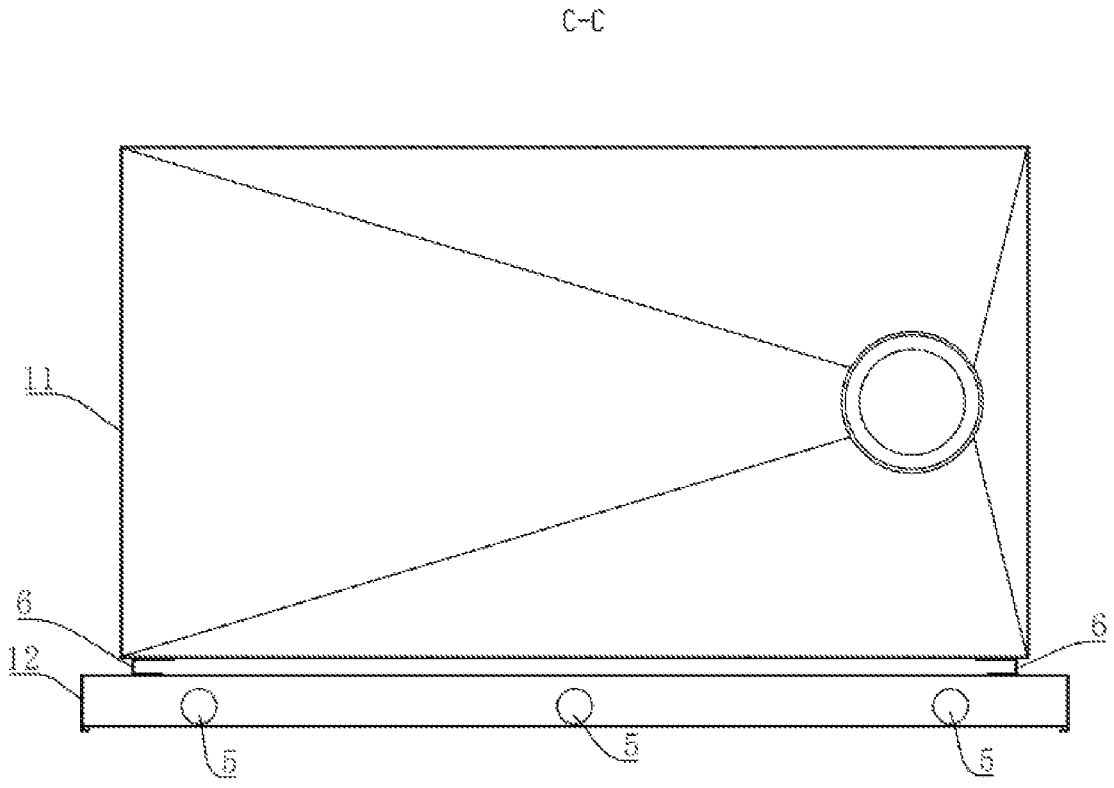
FIG. 11 is a cross-sectional view taken along line C-C of FIG. 10.

As shown in FIG. 4 to FIG. 5, the kitchen sink further comprises a connector 6. The connecting wall 122 is connected with the front side wall of the main tank body 11 through the connecting wall 6. The connecting wall 6 is a U-shaped sheet metal part. The connecting wall 6 is welded with the lower part of the front side wall of the main tank body 11. The connecting wall 6 is welded with the connecting wall 122, and the connecting wall 6 is completely hidden in the rear side of the front tank body 12. As shown in FIGS. 10 and 11, the connecting wall 6 comprises two parts which are bilaterally symmetrically provided.

As shown in FIG. 7 to FIG. 9 and FIG. 4, the kitchen sink further comprises a decorative plate 2. The decorative plate 2 can be inserted into the mounting groove 13 from bottom to top. After the decorative plate 2 is inserted into the mounting groove 13, the stop strip 121 covers the upper edge, the left edge and the right edge of the decorative plate 2. The decorative plate 2 may be made of a plastic plate, a composite plate, a metal plate and other plates with lower cost than marble.

Figure 9:
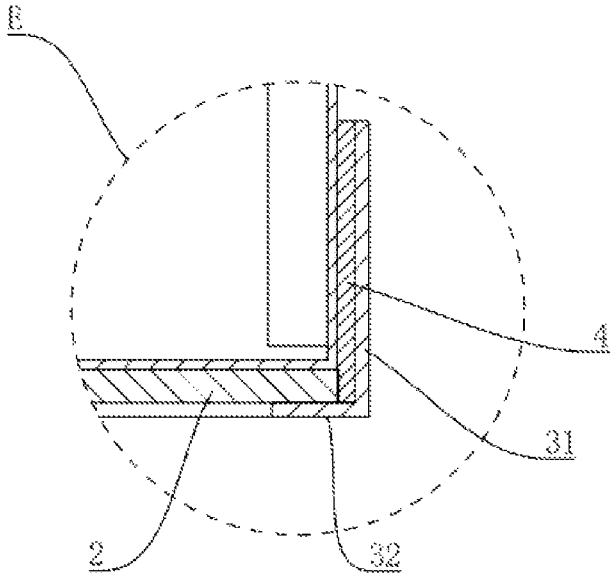
FIG. 9 is an enlarged view of part E of FIG. 7.

As shown in FIGS. 3 and 4, the kitchen sink further comprises a mounting plate 3 and a magnetic attraction plate 4. The magnetic attraction plate 4 may be a silica gel magnet 5, As shown in FIGS. 3 and 9, the magnetic attraction plate 4 is provided on the bottom plate 31 and is magnetically connected with the bottom plate 31. The mounting plate 3 comprises a bottom plate 31 bent backwards and a front plate 32 bent upwards. The bottom plate 31 is magnetically connected with the kitchen sink body 1, and the front plate 32 is attached to the front side of the decorative plate 2.

The kitchen sink body 1 is prefabricated. After a U-shaped groove with a forward opening is formed on the cabinet top, the kitchen sink body 1 is hung on the U-shaped groove through the flange 111, and then the decorative plate 2 is inserted into the mounting groove 13 from bottom to top. The upper edge, the left edge and the right edge of the decorative plate 2 are covered by the stop strips 121. The magnetic attraction plate 4 is then placed on the bottom plate 31 of the mounting plate 3. The mounting plate 3 is pushed from front to back until the front plate 32 of the mounting plate 3 is attached to the decorative plate 2, and the magnetic attraction strip is attached to the bottom of the front tank body 12.

Figure 12:
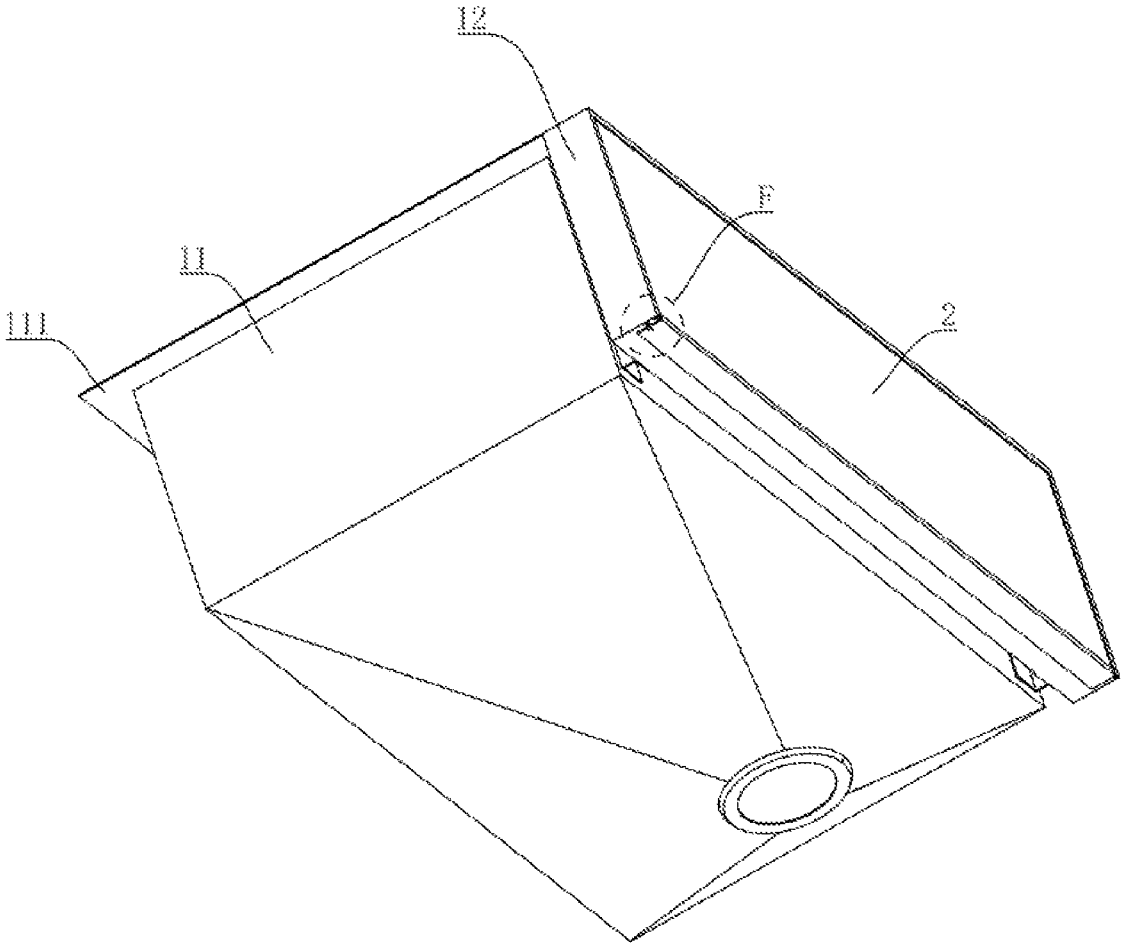
FIG. 12 is a structural diagram of a second embodiment of a kitchen sink capable of quickly replacing decorative plates according to the present disclosure.
Figure 13:
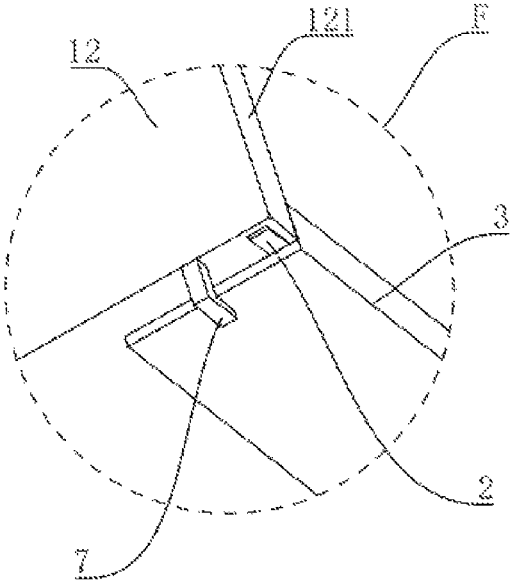
FIG. 13 is an enlarged view of part F of FIG. 12.

As shown in FIG. 12 and FIG. 13, a second embodiment of the kitchen sink capable of quickly replacing the decorative plate 2 according to the present disclosure is different from the first embodiment in that:

the bottom of the front tank body 12 is provided with hooks 7, a gap is formed between the hooks 7 and the bottom of the front tank body 12, a plurality of hooks 7 are provided, and the bottom plate 31 of the mounting plate 3 is inserted into the gap on the hooks 7.

Figure 14:
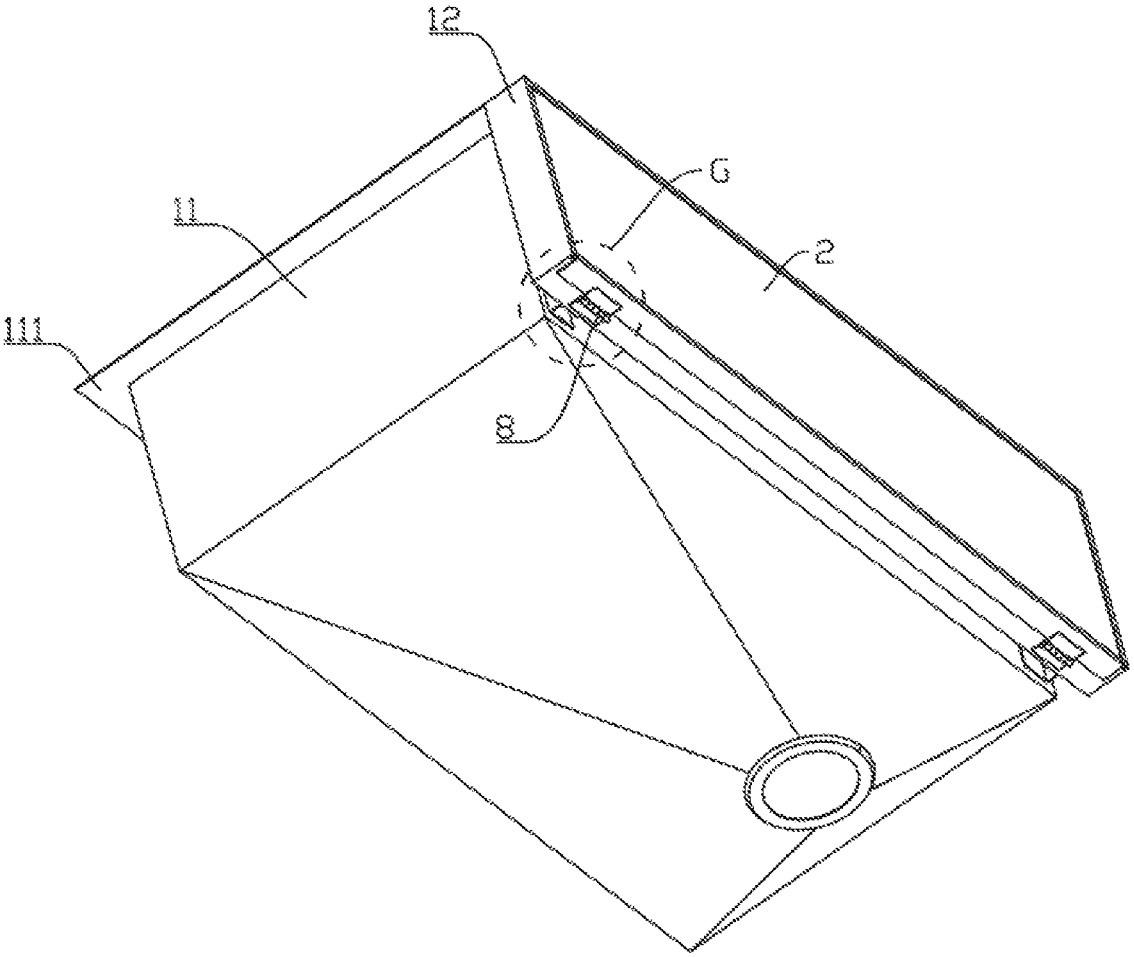
FIG. 14 is a structural diagram of a third embodiment of a kitchen sink capable of quickly replacing decorative plates according to the present disclosure.
Figure 15:
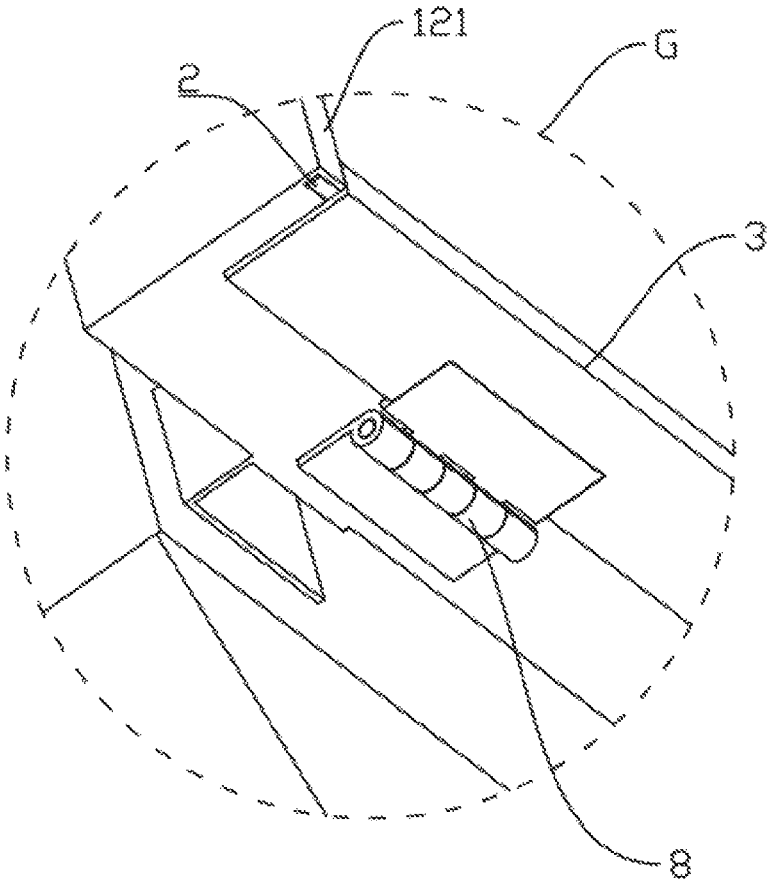
FIG. 15 is an enlarged view of part G of FIG. 14.

As shown in FIG. 14 and FIG. 15, a third embodiment of the kitchen sink capable of quickly replacing the decorative plate 2 according to the present disclosure is different from the first embodiment in that:

the bottom of the front tank body 12 is provided with a hinge 7, and the bottom plate 31 is hinged with the bottom of the front tank body 12 through the hinge 7.

The above are only the preferred embodiments of the present disclosure, rather than limit the patent scope of the present disclosure. All equivalent structural changes made using the contents of the specification and drawings of the present disclosure under the inventive concept of the present disclosure, which are directly or indirectly applied in other related technical fields, are included in the scope of protection of the present disclosure.

What is claimed is:

1. A kitchen sink capable of replacing decorative plates, comprising:

a kitchen sink body, decorative plates and mounting plates, wherein an upper edge, a left edge and a right edge of a front side wall of the kitchen sink body are all provided with mounting grooves, each decorative plate is capable of being inserted into the mounting grooves from bottom to top, each mounting plate comprises a bottom plate bent backwards and a front plate bent upwards, each bottom plate is magnetically connected or clamped with the kitchen sink body, and each front plate is attached to a front side of one of the decorative plates;

the kitchen sink further comprises a magnetic attraction plate which is provided on each bottom plate and welded with each bottom plate.

2. The kitchen sink capable of replacing decorative plates according to claim 1, wherein:

the kitchen sink body comprises a main tank body with an open top and a front tank body with an open rear, a top of the main tank body is provided with a flange, the top of the front tank body is welded with the flange, and a bottom of an inner cavity of the front tank body is provided with a magnet.

3. The kitchen sink capable of replacing decorative plates according to claim 2, wherein;

the kitchen sink further comprises a connector, a bottom of the front tank body is provided with a connecting wall which turns upwards, and the connecting wall is connected with a front side wall of the main tank body through the connector.

4. The kitchen sink capable of replacing decorative plates according to claim 3, wherein:

the connector is a U-shaped sheet metal part, the connector is welded with a lower part of the front side wall of the main tank body, the connector is welded with the connecting wall, and the connector is completely hidden in the rear side of the front tank body.

5. The kitchen sink capable of replacing decorative plates according to claim 4, wherein:

the connector comprises two parts which are bilaterally symmetrically provided.

6. The kitchen sink capable of replacing decorative plates according to claim 2, wherein:

each bottom plate is capable of being attracted by a magnet.

* * * * *